United States Patent [19]

Nabholz

[11] 4,292,744

[45] Oct. 6, 1981

[54] SEPARATION APPARATUS FOR A CONDENSATION-DRYING PLANT

[75] Inventor: Hans U. Nabholz, Ennetbaden, Switzerland

[73] Assignee: Micafil AG, Zurich, Switzerland

[21] Appl. No.: 962,699

[22] Filed: Nov. 21, 1978

[51] Int. Cl.[3] ..... F26B 21/08

[52] U.S. Cl. ..... 34/73; 34/77; 34/78; 134/108; 134/109

[58] Field of Search ..... 134/108, 109; 34/73, 34/76, 77, 78

[56] References Cited

U.S. PATENT DOCUMENTS 3,605,279 9/1971 Fiser et al. ..... 34/104

4,014,751 3/1977 McCord ..... 134/108

FOREIGN PATENT DOCUMENTS 2552746 5/1977 Fed. Rep. of Germany .

*Primary Examiner*—Larry I. Schwartz

*Attorney, Agent, or Firm*—Burns, Doane, Swecker & Mathis

[57] ABSTRACT

A separation apparatus for a condensation-drying plant is disclosed wherein in an autoclave the material to be dried is heated by the heat of condensation of a readily volatile fluid and where this material contains a less volatile fluid (e.g. oil). Two evaporators are provided to separate this less volatile fluid during the drying process. Thermal energy is conserved by feeding the steam of the more volatile fluid from the first evaporator to the autoclave.

5 Claims, 3 Drawing Figures

SEPARATION APPARATUS FOR A CONDENSATION-DRYING PLANT

BACKGROUND OF THE INVENTION

The invention concern a separation apparatus for a drying plant wherein the material to be dried is heated by the heat of condensation of a readily volatile fluid (e.g., kerosene) and where in the course of the heating process this fluid becomes mixed with a less volatile fluid. The separation apparatus is a part of a drying plant comprising an autoclave that is capable of being evacuated, a main evaporator, a steam condenser, control devices, measuring instruments, and storage tanks which are interconnected by means of a pipeline system.

Arrangements of this type are useful, for example, for treating transformers which must be dried and degasified before they are filled with oil. The insulation of transformers which are pre-impregnated or are being repaired contain oil. Then during the drying process this oil will be extracted from the insulation. It is well known that oil is soluble in various carbon derivatives (e.g., kerosene).

If the drop in steam pressure due to the raising oil concentration becomes excessive, it becomes necessary to separate the oil to avoid impairment of the heating-up process. To achieve this, processes are known wherein a partial flow of the liquid kerosene/oil mixture is conducted in to an evaporator from which the therein evaporated kerosene is fed to a condenser operated at a low pressure. This arrangement has the disadvantage that the thermal energy used for the separation process is lost.

Condensation-heating plants have been also proposed where not only a partial flow but all of the kerosene to be vaporized, together with the oil dissolved therein, is conducted to an evaporatior of sufficiently large respectively high capacity and temperature, wherein the thermal energy is not lost. See, for example, the film evaporator described in published German patent application No. 25 52 746. This process has the disadvantage, however, that so high temperatures are required to provide a low residue of kerosene in the separated oil, that certain degradation of the separated oil is inavoidable. This separation device has the further disadvantage of requiring large dimensions since it must generate the full vapor volume.

SUMMARY OF THE INVENTION

It is the aim of this invention to provide an improved separation apparatus which will provide low thermal losses and operate at a relatively low temperature. The invention solves this problem in the manner by which the separation apparatus is divided into stages.

In accordance with this invention, the material to be dried (e.g. a transformer) is heated by means of condensation heat of a readily volatile fluid (e.g. kerosene). The separation apparatus comprises two stages, a first and a second evaporators within which the fluid removed from the insulation (e.g. oil) is separated from the kerosene, the evaporated kerosene from the first stage is fed to the autoclave and the vapor of the second to a condenser. The first stage can be designed in the form of an evaporator which communicates with the main evaporator. The second stage can be designed in the form of a chute evaporator which can be surrounded by the first stage, with a heating device in the wall between the two stages, and both stages being enclosed by the main evaporator. The flow of the kerosene-containing mixture (e.g. kerosene/oil) from the main evaporator to the first stage is determined by the heating input into the first stage. The concentrated kerosene/oil mixture from the first stage evaporator is fed to the second stage, operating at a lower pressure. The vaporizing energy of the second stage does not contribute to the heating up of the material to be dried. This energy is lost. However, the overall loss of energy incurred by the two-stage separation arrangement of this invention is approximately only one fourth of the energy loss of single stage separation system connected to a condenser operating at low pressure.

Further on the divison of the separation apparatus into two stages makes it possible to employ low temperatures, thus insuring a good quality of the separated oil at all times.

If the heat input is relatively low, the use of economic chute evaporators will be advantageous while in the case of high-capacity evaporators the use of film evaporators will be useful. If the distilled kerosene is desired to be substantially pure, it will be expedient to employ fractionating columns to purify the kerosene by way of fractionation. It will be particularly advantageous to design the first stage of the separation apparatus in the form of a vessel which communicates with the main evaporator.

A preferred embodiment arranges the two stages of the separation apparatus inside the main evaporator axially in such manner that the second stage evaporator is surrounded by the first stage evaporator, and that both stages are enveloped by the main evaporator. The second stage of the separation apparatus is most expediently designed in the form of a chute evaporator, with a heating device placed between the lateral surfaces of the two stages.

For the purpose of controlling the flow of the oil/kerosene mixture from the first stage into the second stage of the separation apparatus it will further be advantageous to provide the first stage with a heating device of uniform output and with a temperature sensor, and to place a flow regulator in the pipeline leading from the first stage to the second stage. This arrangement is advantageous because the flow regulator will only open when the temperature in the first stage has reached a predetermined value, thus insuring that only a pre-concentrated oil/kerosene mixture flows into the second stage.

DESCRIPTION OF THE PREFERRED EMBODIMENTS

Figure 1:
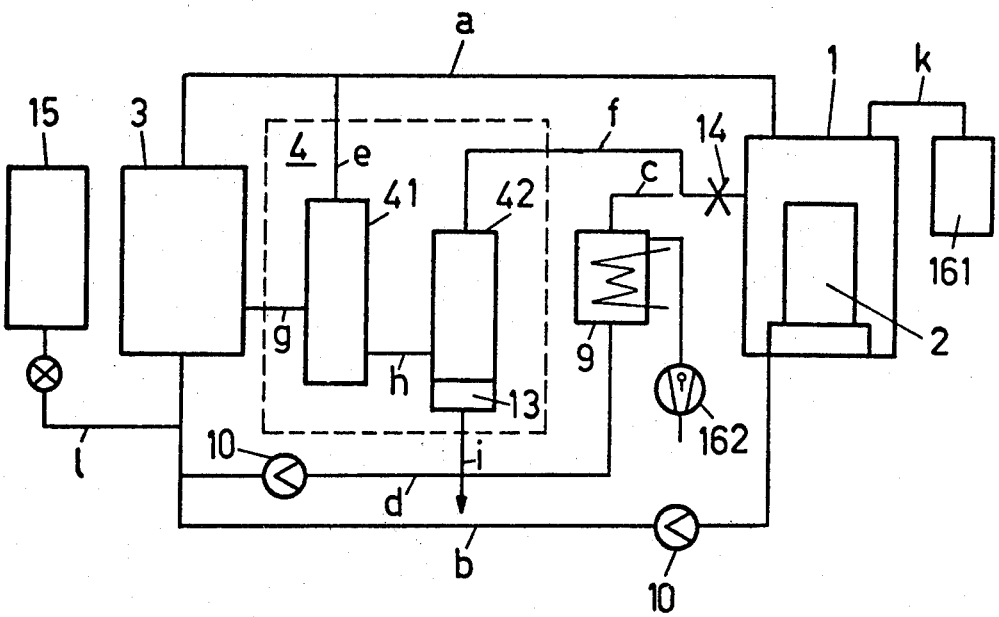
FIG. 1 depicts in diagram form a condensation-drying plant with the separation apparatus of this invention.

In FIG. 1 there is depicted an autoclave 1 and a main evaporator 3, the two units being operably connected to each other by way of vapor pipeline a and a pipeline b for the discharge of the condensated volatile fluid. A steam discharge pipe c leading from the autoclave 1 to a steam condenser 9 carries a baffle 14, and the steam condenser 9 is also connected with the main evaporator 3 by a condensation discharge pipeline d. The autoclave 1 which accommodates the material to be dried (e.g., a transformer 2) is connected with a main vacuum device 161 by way of a vacuum pipeline k. The steam condenser 9 is provided with an auxiliary vacuum device 162. The main evaporator 3, which can be designed in the form of a tubular evaporator carrying vertically and/or horizontally arranged heating elements, is connected by feed pipelines g and h with a two-stage separation apparatus 4 comprised of stages 41 and 42 (i.e. sequential evaporators or vaporizers). A tank 15 containing a supply of kerosene is connected with the main evaporator 3 by a connecting pipeline 1 by way of pipeline b. A steam discharge pipeline e of the first stage 41 is connected with the main steam pipeline a. A steam discharge pipeline f of the second stage 42 is connected with the steam condenser 9. Within the pipelines b and d for the discharge of the condensation product there are placed the circulating pumps 10 (e.g., centrifugal pumps). A discharge pipeline i leads from the second stage 42 of the separation apparatus 4 to the oil storage tanks. The first stage 41 of the separation apparatus can be designed in the form of a chute evaporator, film evaporator, fractionating column or tubular evaporator with vertically and/or horizontally arranged heating elements, and the second stage 42 in the form of a chute evaporator, film evaporator or fractionating column.

Figure 2:
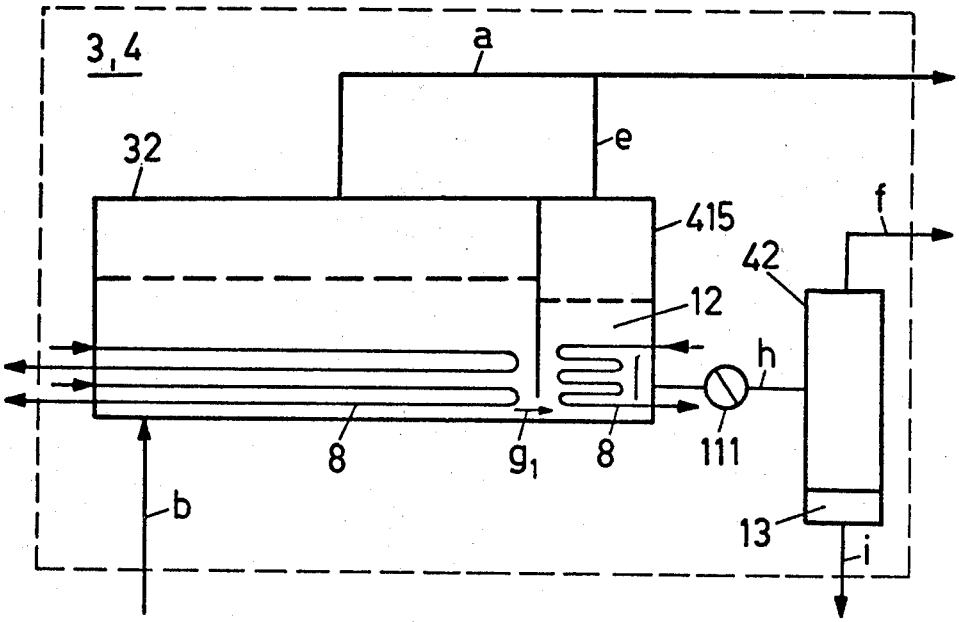
FIG. 2 depicts one embodiment of the separation apparatus wherein the first stage is in the form of a vessel which communicates with the main evaporator.

FIG. 2 depicts a separation apparatus where the first stage 415 forms with the main evaporator 32 a communicating vessel by way of a connecting pipeline $g_1$, and where the main evaporator 32 and the first stage 415 are designed in the form of tubular evaporators 32 and 415, respectively, with horizontally arranged heating elements 8. Between the first stage 415 and the second stage 42 of the separation apparatus there is provided a connecting pipeline h which incorporates a flow regulator.

Figure 3:
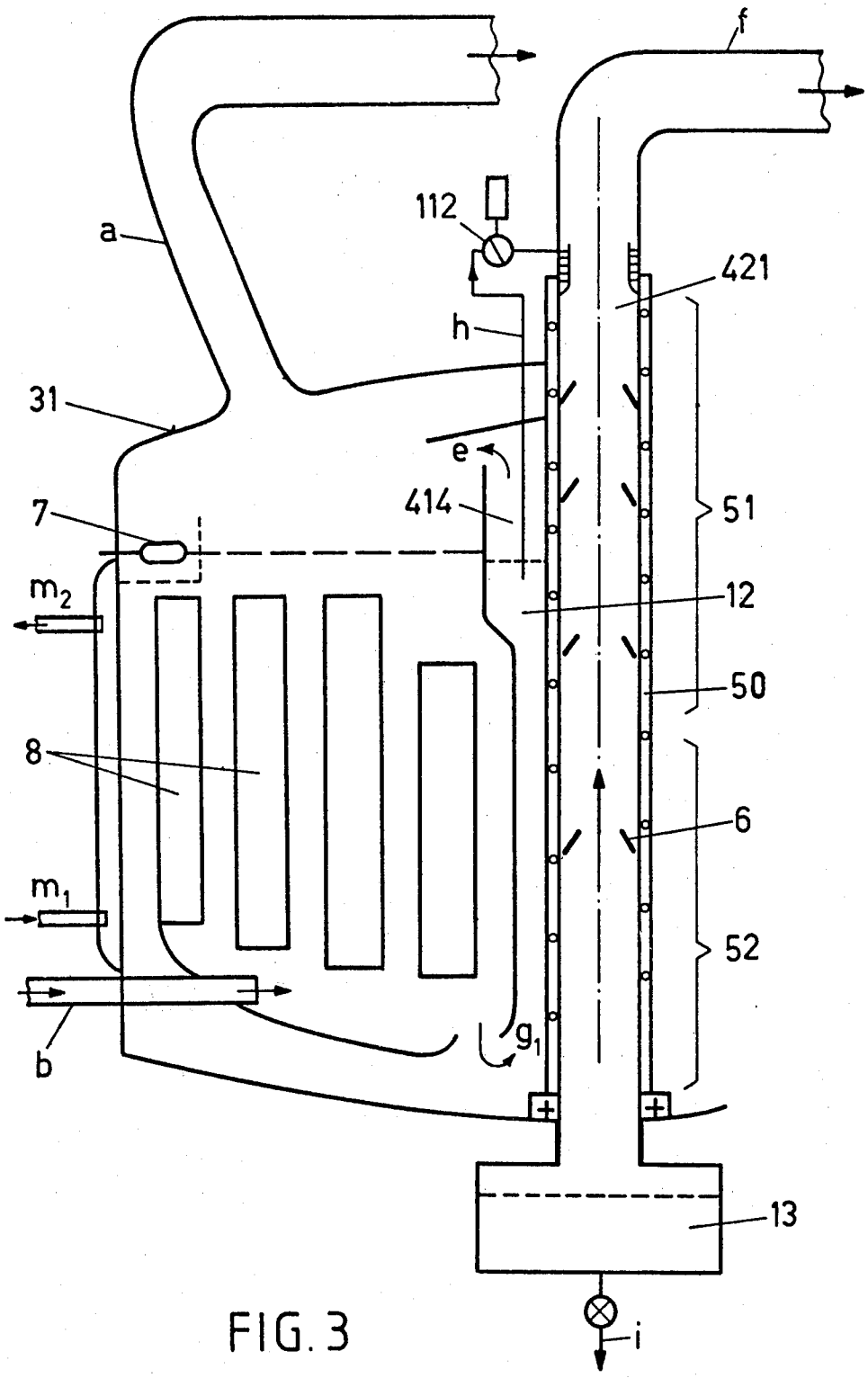
FIG. 3 shows another embodiment of the separation apparatus of this invention wherein both stages are enclosed by the main evaporator.

FIG. 3 illustrates an arrangement where the main evaporator is designed in the form of a tubular evaporator 31 with vertically arranged heating elements 8, and where the two stages of the separation apparatus are situated axially within the main evaporator 31 such that the second stage, designed in the form of a chute evaporator 421, is surrounded by the first stage, designed in the form of a tubular evaporator 414. Both stages are surrounded by the main evaporator 31. A float 7, controlling the level of the fluid, regulates the flow of kerosene into the main evaporator 31 by way of pipeline b which discharges the condensation product. The second stage may also be designed in the form of a film evaporator. A heating device 50 is placed within the double-walled tube of the chute evaporator 421 which is divided into one upper section 51 and one lower section 52. Inside the chute evaporator 421 there are placed sheet metal guides 6. Inside the evaporation chamber of the first stage 414 there is placed a temperature sensor 12 which is immersed in the fluid. A flow regulator is located between the first stage and the second stage and may be in the form of up to six solenoid valves 112 which are connected in parallel. The flow from the first stage 414 to the second stage 421 takes place by way of pipelines h controlled by the solenoid valves. From a sump 13, equipped with a not-illustrated heating device, the sump product is removed by way of the discharge pipeline i. The main evaporator 31 has a supply pipeline $m_1$ and a discharge pipeline $m_2$ for the heating oil, the directions from and to the not-illustrated heating source indicated by arrows.

The separation apparatus 4 illustrated in FIG. 1 separates the oil from a fluid mixture such as a kerosene/oil mixture in the following manner: The initially pure kerosene is vaporized in the main evaporator 3. It condenses in the autoclave 1 in the presence of the material to be dried (e.g., a transformer 2), thereby heating the material. The fluid which is pumped from the autoclave 1 to the main evaporator 3 by way of the pipeline b will now contain oil which has been removed from the transformer. The separation of the oil from the kerosene is accomplished in accordance with the invention in two stages 41 and 42 of the separation apparatus 4. A partial flow of the kerosene/oil mixture is conducted from the main vaporizer or evaporator 3 to the first stage 41 by way of the pipeline g. Since the first stage 41 serves only to preconcentrate the oil the temperature can be kept relatively low in this stage, and the pressure is high enough to feed the kerosene vapor, generated in the first stage 41 into the pipeline a. The vaporizing energy of the stage 41 is therefore not wasted. The aggregate kerosene/oil mixture, collected in the stage 41 is conducted by pipeline h from the first stage 41 to the second stage 42. The kerosene vapor from the second stage 42 flows by way of pipeline f and c to the condenser 9. The second stage 42 operates at a lower pressure than the first stage 41. The vaporizing energy of the second stage 42 is thus lost in the drying process proper. The concentration of oil in the main vaporizer or evaporator 3 can initially be relatively high. It must be low only when the temperature of the material 2 to be dried approaches the maximum permissible temperature $T_{max}$. It becomes possible, (e.g. 130° C.) by utilizing these considerations, to reduce the evaporation rate of the first stage 41 advantageously to approximately one tenth of the rate of the main evaporator 3.

With respect to the embodiments shown by FIGS. 2 and 3, any necessary control devices can be designed in a relatively simple manner. In the case of the embodiment depicted by FIG. 2, the main evaporator 32 and the first stage 415 of the separation apparatus 4 are in the form of communicating vessels so that the inflow from the main evaporator 32 into the first stage 415 takes place through the communicating pipeline $g_1$. If the vapor flow from the first stage 415 by way of pipeline e according to the embodiment of the invention as illustrated in FIG. 2, is sufficiently large relative to the fluid volume of the first stage 415, the oil concentration will rise more quickly in the first stage than in the main evaporator 32. The vapor flow from the first stage 41 into the main vapor pipeline a by way of pipeline e, will remain nearly constant due to the uniform heating input in the first stage 415. However, the temperature of the first stage will rise as the oil concentration increases. When the temperature of the kerosene/oil mixture in the first stage 415 approaches the maximum permissible value, (e.g. 150° C.) the flow regulator, controlled by the temperature sensor 12, opens gradually, thereby insuring that only a sufficiently preconcentrated oil/kerosene mixture will be conducted into the second stage. The regulator is formed, for example, by a variable shutoff cock 111, thus controlling the flow from the first stage to the second stage by way of pipeline h.

In the case of the embodiment of the invention illustrated by FIG. 3, a constant heating input is applied to the upper section 51 of the heating device located within the walls separating the first stage 414 and the second stage 421. The flow into the second stage 421 is again controlled on the basis of the temperature attained in the first stage 414 as measured by temperature sensor 12. A specific embodiment, shown in FIG. 3, is the arrangement of six solenoid valves 112 which are connected in parallel and distributed at the top of the second stage 421, acting as flow regulators, and where the number of open valves is determined and controlled by the difference between the maximum temperature desired and the actual temperature in the first stage. The energy loss of the two-stage separation apparatus of this invention is approximately one fourth of the energy loss of the known single-stage separation device which is connected with a steam condenser.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A separation apparatus for a drying plant wherein the material to be dried is heated by the heat of condensation of a readily volatile fluid, said separation apparatus comprising:

an autoclave that is capable of being evacuated;

a plurality of evaporators operably connected and consisting of a main evaporator and first and second stage evaporators;

means to convey vapor from said main evaporator to said autoclave;

means to convey vapor from said first stage evaporator to said autoclave;

means to convey liquid condensate from said autoclave to said main evaporator;

heating means to supply heat to said plurality of evaporators;

means to convey liquid between said evaporators; and means to remove liquid from said second stage evaporator.

2. A separation apparatus as defined in claim 1 wherein the first stage evaporator is designed in the form of a vessel which communicates with the main evaporator.

3. A separation apparatus as defined in claim 1 wherein the first and second stage evaporators are arranged axially within the main evaporator in such a manner that the second stage evaporator is surrounded by the first stage evaporator with both the first and second stage evaporators being enveloped by the main evaporator.

4. A separation apparatus as defined in claim 3 wherein the second stage evaporator is in the form of a chute evaporator and a heating device is placed between the lateral surfaces of said first and second stages.

5. A separation apparatus as defined in claims 1, 2, 3 or 4 wherein there is provided within said first stage evaporator a heating device which provides uniform heat input thereto as well as a temperature sensor, with a liquid flow regulator situated between said first and second evaporators to regulate liquid flow therebetween.

* * * * *